United States Patent [19]

Grötsch et al.

[11] Patent Number: 4,981,383

[45] Date of Patent: Jan. 1, 1991

[54] DEVICE FOR SCREWING A WRITING INSTRUMENT TIP INTO A WRITING FLUID RESERVOIR

[75] Inventors: Gerald Grötsch, Fürth; Karl Kaiser, Wendelstein, both of Fed. Rep. of Germany

[73] Assignee: J. S. Staedtler GmbH & Co., Nuremberg, Fed. Rep. of Germany

[21] Appl. No.: 449,387

[22] Filed: Dec. 7, 1989

Related U.S. Application Data

[63] Continuation of Ser. No. 110,010, Oct. 13, 1987, abandoned.

[30] Foreign Application Priority Data

Nov. 4, 1986 [DE] Fed. Rep. of Germany ..... 3637454

[51] Int. Cl.[5] ..... B43K 15/00; B43K 9/00; B43K 29/00

[52] U.S. Cl. ..... 401/195; 81/124.3; 401/134; 401/258; 411/911

[58] Field of Search ..... 401/258, 195, 134; 81/124.3; 411/911

[56] References Cited

U.S. PATENT DOCUMENTS

| | | | |
|---|---|---|---|
| 347,262 | 8/1886 | Wood | 81/124.3 |
| 2,197,283 | 4/1940 | Ward | 81/124.3 |
| 3,830,574 | 8/1974 | Glombitza et al. | 401/195 |
| 3,929,152 | 12/1975 | Graham | 81/124.3 X |
| 4,125,051 | 11/1978 | Herkes et al. | 411/911 X |
| 4,352,614 | 10/1982 | Hirsch | 81/124.3 X |

FOREIGN PATENT DOCUMENTS

| | | | |
|---|---|---|---|
| 2557705 | 6/1977 | Fed. Rep. of Germany | 401/258 |

*Primary Examiner*—Steven A. Bratlie
*Attorney, Agent, or Firm*—Pascal & Associates

[57] ABSTRACT

Apparatus for screwing a writing instrument tip into a writing fluid reservoir in a writing instrument in which the connection from the reservoir to the tip, in order to supply the writing fluid to the tip, is made by the screwing action just prior to using the writing instrument, in which the writing instrument tip has at least a first working surface upon which at least a second working surface of a wrench acts, the working surfaces being formed as a ratchet and pawl which only engage in a screwing direction and permitting a relative rotation of the working surfaces in an unscrewing direction. As a result the tip cannot be unscrewed from the writing fluid reservoir, avoiding contamination, air entry or blockages.

2 Claims, 3 Drawing Sheets

DEVICE FOR SCREWING A WRITING INSTRUMENT TIP INTO A WRITING FLUID RESERVOIR

This is a continuation of application Ser. No. 110,010, filed Oct. 13, 1987, now abandoned.

FIELD OF THE INVENTION

This invention relates to writing instruments and in particular concerns a device for screwing a writing instrument tip into a writing fluid reservoir.

BACKGROUND OF THE INVENTION

In so-called single use or disposable writing instruments, the lives of writing instrument tip, adjustment system and content of the writing fluid reservoir are adapted to one another. Prior to using the writing instrument, the writing instrument tip is screwed onto the writing fluid reservoir. A protrusion, which penetrates a diaphragm on the writing fluid reservoir, is located at the threaded end of the writing instrument tip and, as a result of this, flow of the writing fluid to the tip becomes possible. In this respect, reference is made to of German Pat. No. 25 38 427.

As is previously known, a hexagon is provided on the writing instrument tip to enable the writing instrument tip to be screwed into the writing fluid reservoir. A wrench, which has a hexagonal recess, engages with this hexagon. This hexagonal recess can be formed on the cap of the writing instrument or on the writing instrument shaft. Examples of this structure are described in German Design Pat. No. 71 00 878, German Pat. No. 22 22 593 and Japanese Design Pat. No. 58-42132.

The disadvantage associated with these known devices is that the writing instrument tip can be partially or completely unscrewed from the writing fluid reservoir by means of the wrench. If the unscrewing takes place before the writing fluid is completely used up, then contamination, air entry or blockages can occur. When the tip is completely unscrewed, attempts are usually made to reuse an already useless writing tip.

SUMMARY OF THE INVENTION

It is, therefore, the object of the invention to construct the device in such a way that the writing instrument tip can be screwed into the writing fluid reservoir by means of the wrench, but cannot be unscrewed.

A preferred embodiment of the present invention is apparatus for screwing a writing instrument tip into a writing fluid reservoir in a writing instrument in which the connection from the reservoir to the tip, in order to supply the writing fluid to the tip, is made by the screwing action just prior to using the writing instrument, in which the writing instrument tip has at least a first working surface upon which at least a second working surface of a wrench acts, the working surfaces being formed as a ratchet and pawl which only engage in a screwing direction and permitting a relative rotation of the working surfaces in an unscrewing direction.

BRIEF INTRODUCTION TO THE DRAWINGS

Embodiments of the invention will be explained in greater detail in the following description with reference to the drawings, showing:

DETAILED DESCRIPTION OF THE INVENTION

Figure 2:
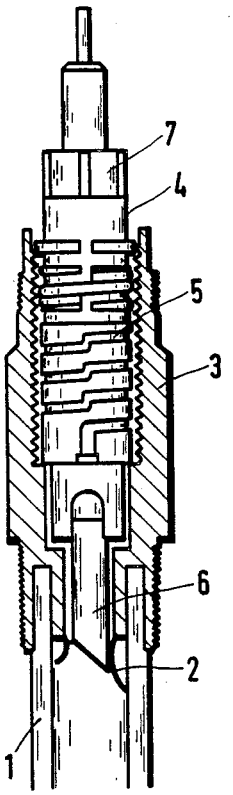
FIG. 2 is an illustration corresponding to FIG. 1 with a completely screwed on tip.
Figure 1:
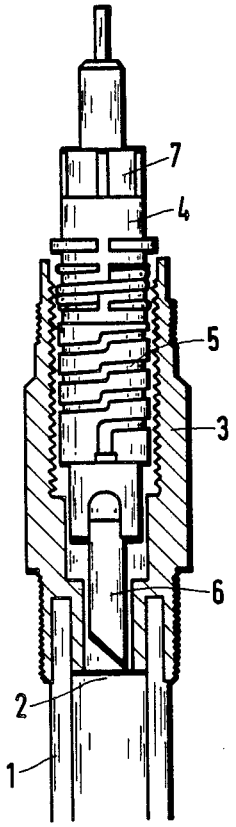
FIG. 1 is a section through the front end of a writing fluid reservoir having a partially screwed on writing instrument tip according to the prior art.

Referring to FIGS. 1 and 2, the writing fluid reservoir 1 is closed at its front end by a diaphragm 2, which prevents the content of the reservoir from drying out prior to use. At its front end, the writing fluid reservoir has a collet 3 into which the writing tip 4 can be screwed. The writing tip 4 is provided with an adjustment system 5 in the illustrated example. The writing tip has a protrusion 6 at the threaded end, by means of which diaphragm 2 is penetrated when the protrusion is screwed into it. In the illustrated example and in accordance with the prior art, writing tip 4 has a square end 7 on which a wrench, which has a square recess, is mounted for screw-in purposes. Writing tip 4 can be unscrewed from the writing fluid reservoir at any time by means of this wrench.

Figure 3:
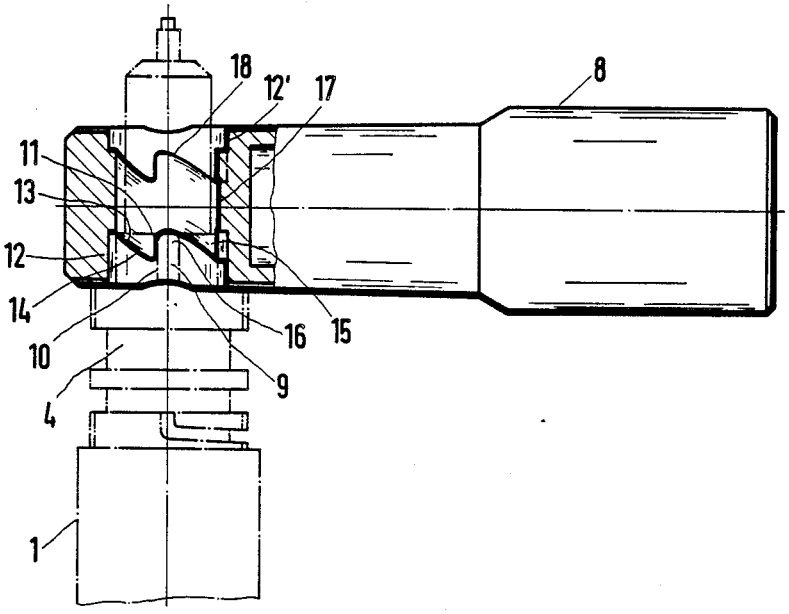
FIG. 3 is a side view of tip and wrench, shown partially in section, in accordance with the invention.
Figure 4:
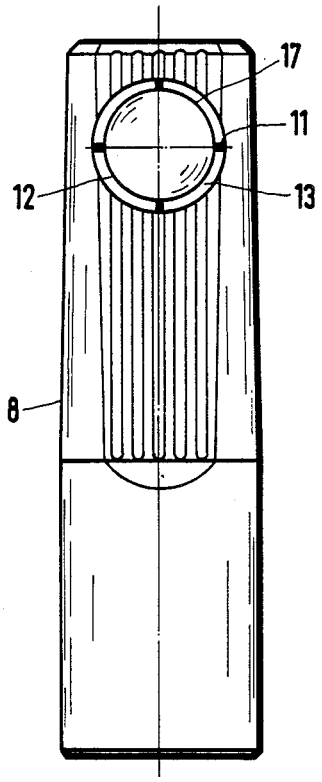
FIG. 4 is a side view of the wrench according to FIG. 3.
Figure 5:
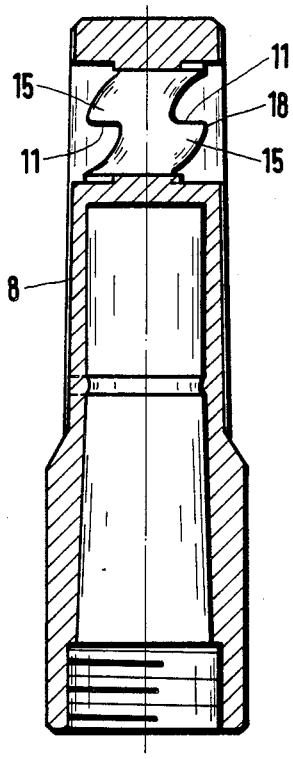
FIG. 5 is an axial section through this wrench.

In order to prevent this, a ratchet and pawl are provided between writing tip 4 and wrench 8 in accordance with FIG. 3 (see also FIGS. 4 and 5). This ratchet and pawl enable a frictional connection between wrench 8 and writing tip 4 in the screw-in direction. If, however, a relative rotation is made in the unscrewing direction, then there is no frictional connection between wrench 8 and writing tip 4, so that a relative rotation between these two parts is possible.

The illustrated ratchet and pawl are an axially acting ratchet and pawl. However, ratchets and pawls, as shown in Richter, Voss, Kozer "Bauelemente der Feinmechanik" [Structural Elements of Precision Mechanics], 8th Edition 1959, Illustrations 43.8 to 43.10 and 43.29 to 43.36, are also possible.

In the simplest case, the ratchet and pawl have an axially extending protrusion 9 on writing tip 4 which forms an axially extending working edge 10. A working edge 11, which also extends approximately axially, comes to rest against this working edge 10 in a bore 12 of wrench 8 which passes over to an edge 13 extending inclined to it. If wrench 8 is turned in the screw-in direction, then the two working edges 10, 11 come to rest against each other, so that wrench 8 takes the writing tip along. If, on the other hand, wrench 8 is turned in opposite direction, then wrench 8 does not take writing tip 4 along since edge 13, extending at an angle, always slides over the protrusion 9. In the illustrated embodiment, wrench 8 has a succession of working edges 11 and angular edges 13, so that a toothed rim with axial teeth 15 is formed. In a congruent manner, a series of working edges 10 and edges 14, extending at an angle thereto, are also provided on the writing tip, which also form a toothed rim with axial teeth 16.

Inversely to bore 12, a further bore 12' is provided, the bores being connected to one another by means of an intermediate bore 17 having a smaller diameter, whereby a toothed rim 18 is also provided in the transition area between the bores 17, 12'. In this way, wrench 8 can be mounted in the one or the other manner onto writing tip 4.

Wrench 8 can be the casing for the writing instrument, or the writing instrument shaft or the cap of the writing instrument.

We claim:

1. A writing instrument including apparatus for preparing it for writing, comprising:

(a) an instrument body containing a writing fluid reservoir closed by a diaphragm, (b) a writing tip containing a puncturing protrusion at a bottom end thereof, the body and tip being mutually threaded so as to retain the tip within the body and to facilitate puncturing of the diaphragm by the puncturing protrusion allowing writing fluid to be carried to the tip, upon rotation of the tip in one direction around its central axis and a resulting progressive axial thrust of the protrusion toward the reservoir, (c) a wrench for engaging the writing tip, the wrench containing a bore having a first diameter for accommodating a top end portion of the tip, and a second wider diameter adjacent a surface of the wrench for accommodating a second portion of the tip which is adjacent the top end of the tip, (d) the tip having at least one working protrusion extending outwardly from the second portion thereof having a working edge about parallel to the axis of the tip, (e) the wrench having a sawtoothed rim having at least one working edge extending about parallel to the axis of the bore, located around the bore and forming a transitional edge between the first and wider diameter portions of the bore, the working edges of the working protrusion and the sawtoothed rim being angled so that upon insertion of the tip into the bore of the wrench, said working edges come to rest against each other allowing rotation of the wrench in one direction to rotate the tip and progressively screw it into the instrument body and the puncturing protrusion to puncture the diaphragm, and upon rotation of the wrench in the other direction allowing an inclined edge of the sawtooth to slide over the working protrusion and thereby make it impossible to unscrew the tip thereby from the instrument body.

2. Apparatus as defined in claim 1, in which the axis of the bore is at right angles to the axis of the wrench.

* * * * *